US005477766A

United States Patent [19]

Ellsworth

[11] Patent Number: 5,477,766

[45] Date of Patent: Dec. 26, 1995

[54] BOEHM SYSTEM CLARINET HAVING IMPROVED A KEY MECHANISM

[76] Inventor: Clifford Ellsworth, 6630 N. 61st Ave., Glendale, Ariz. 85301

[21] Appl. No.: 257,370

[22] Filed: Jun. 9, 1994

[51] Int. Cl.[6] ..... G10D 7/06

[52] U.S. Cl. ..... 84/382

[58] Field of Search ..... 84/380 R, 382, 84/384, 386

[56] References Cited

U.S. PATENT DOCUMENTS

| | | | |
|---|---|---|---|
| 878,333 | 2/1908 | Bonn | 84/382 |
| 1,546,153 | 7/1925 | Upton | 84/382 |
| 2,036,356 | 4/1936 | Pedler | 84/382 |
| 2,180,118 | 11/1939 | Loney | 84/385 |
| 2,832,250 | 4/1958 | Leblanc | 84/382 |
| 2,867,146 | 1/1959 | Mazzeo | 84/382 |
| 3,079,828 | 3/1963 | Leblanc | 84/382 |
| 3,238,833 | 3/1966 | Brodzky | 84/382 |
| 3,394,624 | 7/1968 | Seaman | 84/382 |
| 4,206,680 | 6/1980 | Hanson et al. | 84/382 |
| 4,793,235 | 12/1988 | Yamaryo | 84/382 |
| 4,882,968 | 11/1989 | Yamada | 84/384 |
| 5,237,902 | 8/1993 | Hamanaga | 84/386 |

*Primary Examiner*—Patrick J. Stanzione

*Attorney, Agent, or Firm*—Charles E. Cates; Edward C. Jason

[57] ABSTRACT

A Boehm system clarinet having improved A key features. An auxiliary shaft having an auxiliary actuating spatula in rough proximity to the spatula of the B flat key affords operation of the A key with the right index finger without impairing the operation of that key in the normal manner by the left index finger. A temperature compensation mechanism on the auxiliary shaft assures that the auxiliary shaft cannot freeze up in response to temperature changes and impair operation of the A key in the normal Boehm system mode. An adjustable link mechanism disposed between the A and A flat keys makes the operation of those keys smoother and quieter.

40 Claims, 3 Drawing Sheets

BOEHM SYSTEM CLARINET HAVING IMPROVED A KEY MECHANISM

BACKGROUND OF THE INVENTION

The present invention relates to Boehm system clarinets and is directed more particularly to a Boehm system clarinet which includes an improved A key operating mechanism which allows the A key to be operated by a finger of the right hand without affecting its normal operability by a finger of the left hand.

In a clarinet which is structured and played according to the Boehm system there are a number of problems inherent in the use of the A, A flat and B flat keys. One of these is that there are a number of note sequences which are difficult and/or awkward to play. Two of these, the trills between A and A flat and A flat and B flat, are so awkward, particularly if they must be played rapidly, that they are often avoided or "faked", i.e., produced by the fingering of keys other than those that are called for and only approximating the sound that is called for. Other note sequences, such as the full triad tremolo and tremolos between F and B flat, E flat and B flat, and G flat and B flat are simply difficult to play rapidly because of their tonal separation. Even more difficult are the full triad tremolos between E and A, E flat and A, and D and A.

In addition, there are a number of well known passages which are so difficult that they cannot be played by many highly experienced clarinet players. One of these, the so-called Hora Staccato, calls for the repetitive playing of the note sequence E, B flat, G, B flat. Another, the first clarinet part from the Perpetuum Mobile of Novacek, calls for rapid (presto) alterations between higher and lower B flats. As a result of these difficulties, it has been a not uncommon practice for composers to routinely consult with experienced clarinet players to determine if their compositions present problems that make it advisable that certain passages be deleted or modified.

Prior to the present invention many attempts have been made to eliminate the problems inherent in the Boehm system. One of these, described in U.S. Pat. No. 1,546,153 (Upton), recognizes the above-described problems and describes trilling A and A flat (G sharp) using the first and second joints of the left index finger. However, Upton's solution not only fails to facilitate rapid trilling from A flat to B flat, but also introduces a violation of the standard Boehm fingering scheme.

Another of these attempts, described in U.S. Pat. No. 3,079,828 (LeBlanc), is based on a mechanism which allows the A note to be sounded with the third finger of the right hand. While this mechanism ameliorates certain of the above-described trilling difficulties, it is complicated and therefore potentially unreliable because it utilizes differentially actuating springs. In addition, because of spring interactions, it causes the A key to have an unfamiliar "feel".

Yet another of these attempts, described in U.S. Pat. No. 4,206,680 (Hanson et al), ameliorates certain of the above-described trilling difficulties, but uses a mechanism which is complicated and interferes with the C–D trill above the staff.

Still other attempts to solve the problems which are solved definitively by the present invention are described in the following U.S. Pat. Nos. 878,333 (Bonn), 2,832,250 (LeBlanc), 3,238,833 (Brodzky) and 4,793,235 (Yamaryo).

Another problem inherent in the use of the A key is that it operates in conjunction with the A flat key. More particularly, the depression of the spatula of the A key results in the lifting not only of the A note pad cup, but also the A flat note pad cup. Because the rocker arms of the A and A flat keys are not initially in contact, this leads to an annoying click each time the A note is played and to a peculiar key "feel". Although these effects are reduced by the inclusion of an adjustment screw and an associated pad of cork, they are not eliminated. In any case, the cork pad has a relatively short useful life because it is frequently struck by the end of the adjustment screw.

SUMMARY OF THE INVENTION

In accordance with the present invention there is provided a set of related improvements which definitively solve the above described problems. One of these is an auxiliary A key mechanism which allows the A key to be played with equal ease either by a finger of the right hand or by a finger of the left hand. One beneficial result of the inclusion of this mechanism is that the difficult trills from A to A flat and A flat to B flat can be made easily and with great rapidity even by inexperienced players. Another is that the very difficult tremolos between E and A, E flat and A, and D and A can be made comfortably even when played very rapidly. Thus, the present invention makes easy and routine the playing of trills and tremolos that have been notorious for their difficulty.

In the preferred embodiment, the auxiliary A key mechanism includes an auxiliary shaft having an auxiliary spatula which is in rough proximity to the spatula of the B flat key and which is easily operable by the right index finger. This location makes it possible for a player to play A and B flat with the same finger, thereby simplifying the trill between A and B flat and increasing the speed at which it may be performed. In addition, by releasing the left index finger from its task of operating the A key, the auxiliary mechanism of the invention makes easy the playing of passages, such as the previously mentioned Hora Staccato and Perpetuum Mobile, with their many repetitions of B flat. Thus, the auxiliary A key mechanism of the present invention not only facilitates the playing of trills, tremolos and passages of extraordinary difficulty, it also simplifies the playing of trills of only ordinary difficulty.

In accordance with the present invention the auxiliary A key mechanism includes an auxiliary arm that extends from the auxiliary shaft in rough proximity to the spatula of the A key. This shaft engages the lower (inner) surface of that spatula and serves to allow the A key to be operated from below. This advantageous arrangement allows the key to remain operable in the normal manner (i.e., from above) by the left index finger. This is important because it prevents what would otherwise be a violation of the Boehm fingering scheme. In other words, the instrument is still playable exactly according to the Boehm system, but its playability has been extended by the inclusion of the ability to operate the A key with the right index finger. Thus, the clarinet may be said to incorporate an extension of the Boehm system.

In the preferred embodiment of the invention, the auxiliary shaft is provided with a compensating bushing which moves in and out of a longitudinal opening in the end of the auxiliary shaft as the wooden body of the clarinet expands and contracts with changes in temperature. In this manner there is avoided the possibility that the contraction of the body will cause so much pressure to be applied between the auxiliary shaft and its needle bearings that the shaft will be unable to rotate, i.e., will "bind" or "freeze up". While the importance of this feature is related to the relatively great length of the auxiliary shaft, its utility is not restricted to use with that shaft. It will therefore be understood that the compensating bushing may be used on any shaft on the clarinet which is long enough to be subject to thermally induced freeze-up problems or, more generally, on the shafts of other woodwind or even brass instruments.

Another improvement afforded by the present invention is a separator or linkage mechanism which bridges the arms of the A and A flat keys. This bridging action has the effect of keeping these rocker arms in contact, except when A flat is played by itself. As a result the A key is able to lift the A flat pad cup without having to first strike the A flat key, thereby eliminating the previously mentioned clicking sound. At the same time, the operation of the A key is made smoother and exhibits a much improved feel.

In the preferred embodiment, the linkage mechanism is included as a part of the interkey adjusting mechanism for the A and A flat keys. This coupling of the linkage function with the adjustment function assures that the benefits provided by the linkage mechanism are not lost as a result of adjustments to the A—A flat key gap.

DESCRIPTION OF THE DRAWINGS

Other objects and advantages of the present invention will be apparent from the accompanying drawings in which.

DESCRIPTION OF THE PREFERRED EMBODIMENTS

Figure 1:
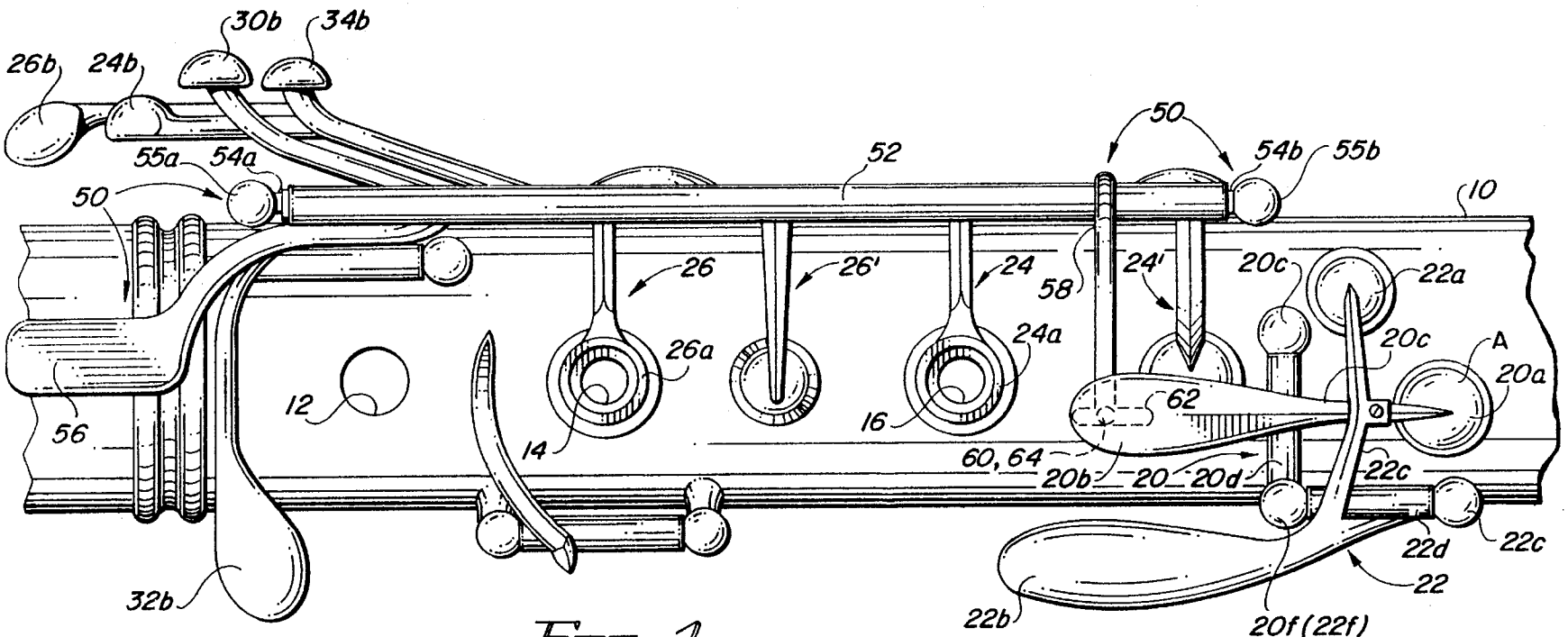
FIG. 1 is a fragmentary top view showing the part of a clarinet on which the invention is used.

Referring to FIG. 1, there is shown a fragmentary top view of the mouthpiece end of a clarinet which has been modified to incorporate the improvements contemplated by the present invention. This clarinet includes a wooden body or tube 10 through which a number of sound holes have been drilled. Hole 12, for example, is open. Holes 14 and 16 are associated with the E and F sharp (G flat) notes, respectively. The remaining sound holes that are located on the section of the clarinet shown in FIG. 1 are not visible in that figure because they are obscured by the pad-bearing cups that cover them. Such holes will be discussed presently in connection with their respective key mechanisms.

The clarinet of FIG. 1 also includes a number of key mechanisms or keys that open and close to control the flow of air through respective sound holes. These include an A key 20 having a pad cup or cup 20*a* that controls the flow of air through the A sound hole (not visible in FIG. 1) and a finger pad or spatula 20*b*. The cup and spatula are joined by an arm 20*c* formed integrally with a shaft 20*d* that is journalled threadedly mounted within bearing posts 20*e* and 20*f*. Together these structures comprise a rocker mechanism that uncovers the A hole when A spatula 20*b* is depressed. Similarly, A flat (G sharp) key 22 includes a cup 22*a*, a spatula 22*b*, an arm 22*c*, a shaft 22*d*, and bearing posts 22*e* and 22*f* (post 22*f* being common to the A and A flat keys), and uncovers the A flat hole when spatula 22*b* is depressed or, as will be described more fully later, when spatula 20*b* is depressed.

The clarinet of FIG. 1 also includes keys that control the E and F sharp (G flat) notes, via holes 14 and 16. Key 24, for example, controls the F sharp note and includes a finger-closeable hole cover 24*a* and a spatula 24*b*. It should be noted that the linkages, shafts, return springs, etc. that form parts of the F sharp key have been left out of FIG. 1 because they are conventional and because their showing would only serve to obscure the parts of the clarinet that form a part of the present invention. Similarly, key 26 controls the E flat note and includes a finger-closeable ring 26*a* and a spatula 26*b*. Associated with E flat key 26 is an E flat helper key 26'. Finally, spatulas 30*b* and 32*b* form parts of the B flat and C sharp keys, respectively, while spatula 34*b* forms a part of the C trill key. The sound holes, linkages, etc. of the last mentioned keys are not for the most part visible in FIG. 1.

Figure 2:
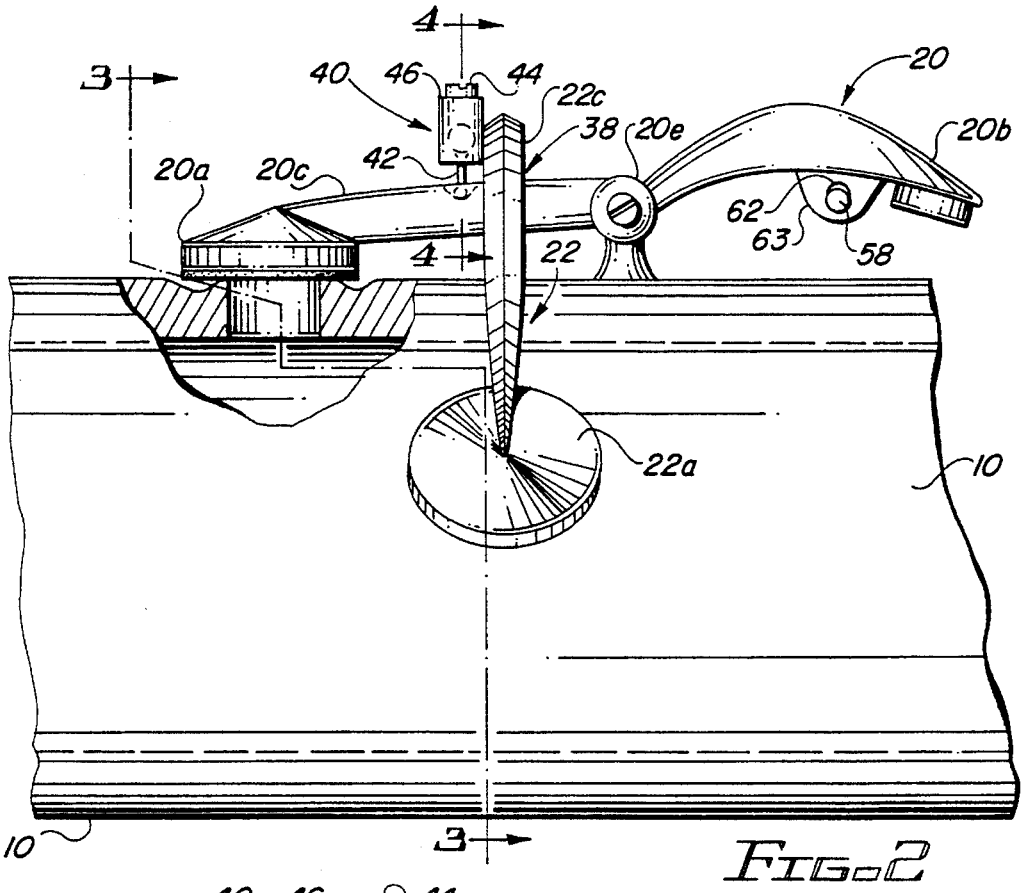
FIG. 2 is a fragmentary, partly cut away, side view of the part of a clarinet which is near the A and A flat keys.
Figure 3:
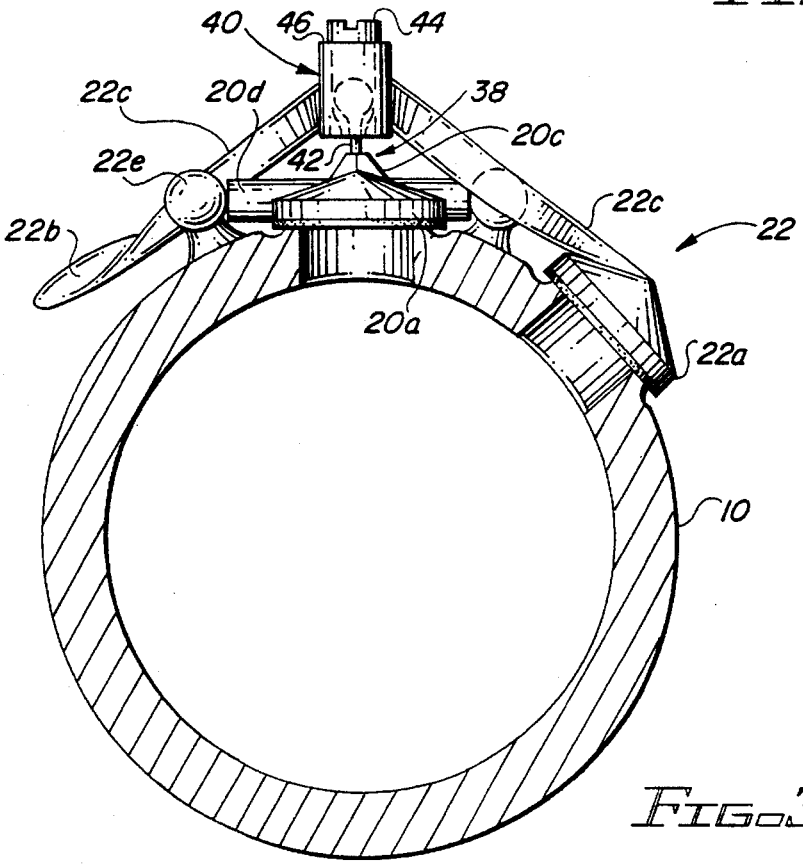
FIG. 3 is a cross-sectional view of the clarinet taken along the section 3—3 shown in FIG. 2.

Turning now to FIGS. 2 and 3, there are shown respective side and front elevations of A and A flat keys 20 and 22. As shown in FIG. 2, arm 22*c* of A flat key 22 extends over or bridges arm 20*c* of A key 20, being separated therefrom by a gap 38. In operation, this bridging relationship and gap allows the A flat note to be played independently of the A note, since the depression of A flat spatula 22*b* (see FIG. 3) causes the A flat pad cup 22*a* to lift without also lifting A note pad cup 20*a*. In playing the A note, however, the depression of A key spatula 20*b* leads not only to the raising of pad cup 20*a*, but also the raising of pad cup 22*c*, i.e., causes both of their respective sound holes to be open at the same time. Prior to the present invention the two sound holes did not open simultaneously, however, since rising arm 20*c* took time to traverse gap 38 before first striking arm 22*c*. Prior to the present invention, this time was made adjustable by including on arm 22*c* a screw which adjustably projected into gap 38 and made contact with arm 20*c* through a cork pad (not shown). While this screw allowed the "feel" of the A key to be adjusted, the making of the contact between arms 20*c* and 22*c* produced a clicking sound, particularly after the cork pad had deteriorated from use.

Figure 4:
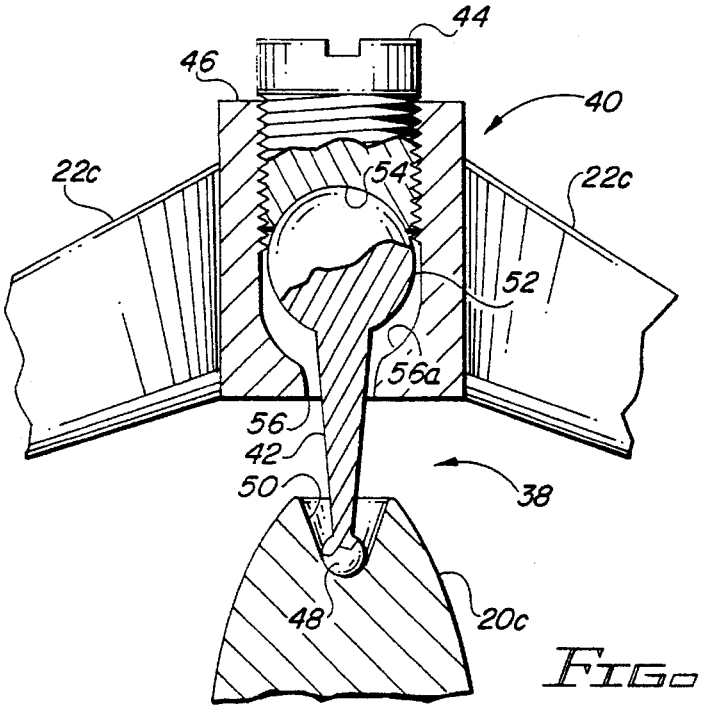
FIG. 4 is a enlarged partial cross sectional view of the clarinet taken along the section 4—4 shown in FIG. 2.

In accordance with one feature of the present invention, one of the above-described unpleasant aspects of the use of the A key is eliminated by providing an adjustable separator or linkage mechanism 40 which is most easily seen in FIG. 4. As will be explained more fully presently, mechanism 40 significantly improves the smoothness and simultaneity of the opening of cups 20*a* and 22*a* by allowing arm 20*c* to move arm 22*c* without having to first strike the same, i.e., without having to move into contact therewith. This not only eliminates the above-mentioned clicking noise, it also improves the purity of the note by eliminating the time when only one of the sound holes is uncovered. Moreover, this result is produced without affecting the adjustability of the width of gap 38, thereby preserving the ability of the user to adjust the "feel" of the A key.

Referring to FIG. 4, there is shown a fragmentary cross-sectional view of one embodiment of linkage mechanism 40. The latter includes an elongated separator or link 42 which is disposed in bridging relationship between key arms 20*c* and 22*c*. Mechanism 40 also includes an adjustment screw 44 which is threaded in a member 46 that is secured to arm 22*c* of A flat key 22. In view of this structure it will be seen that the tightening of screw 44 pushes link 42 further out of member 46 and thereby increases the separation (gap 38) between keys 20 and 22.

A first end 48 of link 42 has a generally rounded shape having a curvature which matches that of the upper surface of a recess 50 that is formed in arm 20*c* and forms a ball and socket type of engagement therewith. Similarly, the other end 52 of link 42 has a generally rounded shape having a curvature which matches that of the lower surface of a recess 54 that is formed in the end of screw 44 and forms a ball and socket type of engagement therewith. Because of the use of this type of engagement it will be seen that, whatever the relative motions of arms 20*c* and 22*c*, link 42 cannot apply to those arms forces which are perpendicular to the plane of rotation of the key and which would therefore tend to cause the keys to bind.

It should be noted that, because recess 54 forms a part of screw 44, the ball and socket engagement between link 42 and arm 22*c* is not affected by the depth to which screw 44 penetrates member 46. As a result, so long as the interior opening 56 through member 46 is sufficiently long to allow a reasonable range of inward and outward movement for link 42, the engagement between link 42 and keys 20 and 22 will remain smooth. This assures that screw 44 may be adjusted as necessary to produce the desired separation between those keys without affecting the smoothness of the engagement. This, in turn, affects the force which must be used to depress A key 20 and therefore the feel of that key.

In the preferred embodiment, the inner (clarinet) end 56*a* of opening 56 has a smaller diameter than the remainder thereof. This smaller diameter assures that link 42 is held between end 56*a* and screw 44 and is therefore unable to escape from member 46. Similarly, the depth of recess 50 in arm 20*c* is selected so that end 48 of link 42 cannot escape therefrom when A flat key 22 is operated independently of A key 20. When the latter key is not depressed, the end 48 of link 42 is retained within recess 50 by the action of the A flat key return spring (not shown). Thus, spacer 42 is maintained in the desired bridging relationship between keys 20 and 22 under all conditions of use or non-use of the clarinet.

As stated previously, the clicking sound associated with the A keys of clarinets constructed in accordance with the present invention is eliminated by the use of the linkage mechanism shown in FIGS. 2–4. The reason is that link 42 serves to maintain a smooth non-binding engagement between keys 20 and 22. Since these keys will normally be in contact, there is no occasion for the production of the clicking sound that had been produced when the A key first struck the A flat key. Such sound as is produced as the A flat key returns to its rest position after being played independently of the A key (i.e., when end 48 of link 42 comes to rest in the bottom of recess 50) is minimal and unobjectionable since link 42 slides smoothly in the recesses between which it is positioned and since its stoppage is cushioned by the return springs of the A and A flat keys.

As explained previously, under the Boehm system, the A and A flat keys are arranged so that they are both operated by the left index finger. While this fingering presents no problem when the A and A flat notes are played separately, or when these notes are trilled slowly, it becomes a problem when A and A flat must be trilled rapidly. Another awkward fingering problem is presented by the rapid trilling between A flat and B flat. Still further problems are presented by the rapid playing of full triad tremolos and other notoriously difficult passages.

In accordance with the present invention, the above-mentioned problems are solved definitively by the inclusion of an auxiliary A note mechanism which allows the A key to be operated with equal ease by the index fingers of either hand, and which does not comprise a violation of the Boehm system. In the embodiment of FIG. 1 this mechanism as a whole is designated by the numeral 50 and extends generally from rough proximity to the spatula 30*b* of the B flat key to rough proximity to the spatula 20*b* of the A key. More particularly, auxiliary mechanism 50 includes an auxiliary shaft 52 which is journalled in and between a pair of needle bearings 54*a* and 54*b* which are, in turn, supported on respective bearing posts 55*a* and 55*b* that are screwed into the body of the clarinet. Auxiliary mechanism 50 also includes an auxiliary spatula 56 which extends from one end of shaft 52 in rough proximity to B flat spatula 30*b* and an auxiliary arm 58 which extends from the opposite end of shaft 52 in rough proximity to A spatula 20*b*. Finally, auxiliary mechanism 50 is an extension of the A key. They move together responsive to the spring associated with the A key. It will be understood that while both the presence of auxiliary mechanism 50 and its location are unconventional, the levers, bearings, etc. which it employs are, except as hereinafter noted, conventional. Accordingly, the latter aspects of the present invention will not be described in detail herein.

In accordance with an important feature of the present invention, auxiliary mechanism 50 in general and arm 58 in particular are arranged so that the depression of auxiliary spatula 56 by the right index finger results in the depression of A key spatula 20*b*, i.e., in the playing of the A note. In the embodiment of FIG. 1 this is accomplished by causing auxiliary arm 58 to engage the underside of spatula 20*b* and pull the same down from its under or inner (clarinet) side. In other words, auxiliary mechanism 50 produces from below with the right index finger, an actuation of the A key which is indistinguishable from the actuation of that key from above by the left index finger. As a result, A spatula 20*b* can be operated interchangeably either with the left index finger, exactly as called for by the Boehm system, or with the right index finger under an extension of the Boehm system which is fully compatible therewith.

In the embodiment of FIG. 1 the desired engagement between arm 58 and spatula 20*b* is afforded by providing arm 58 with a rounded end 60 which serves as a spatula engagement structure and by providing the underside of spatula 20*b* with an inwardly projecting member 62 having a rounded (socket shaped) recess 64 which serves as a arm engagement structure. Together these cooperating structures serves as a ball and socket joint which allows auxiliary spatula 56 to smoothly and reliably control the A key from the vicinity of the B flat spatula. The structure of member 62 and socket 64 are most clearly seen in FIG. 2. It will be understood, however, that any arm—spatula engagement mechanisms which can serve to smoothly link arm 58 with the underside of spatula 20*b* can be used in place of the ball and socket mechanism of FIGS. 1 and 2 is within the contemplation of the present invention.

One additional advantage of locating auxiliary spatula 56 in rough proximity to B flat spatula 30*b* is that it facilitates rapid trilling between A and B flat by allowing this trill to be performed comfortably with the right index finger. While this trill is not particularly difficult with the usual two fingers, it can now be performed as easily or even more easily with a single finger, thereby freeing one finger for playing notes that would not otherwise be playable in conjunction with the A–B flat trill.

Because auxiliary A key mechanism 50 is used as an optionally usable extension of the Boehm system, and because it has a relatively long shaft, it is particularly important that it not subject the playing of the clarinet in its unextended Boehm system mode to an increased risk that the A key will bind or freeze-up as a result of the thermal expansion and contraction of the body of the clarinet. In conventional Boehm system clarinets shafts that are relatively long are always subject to the risk of binding or freezing-up because the coefficient of expansion of the wooden body of the clarinet is substantially greater than that of the shafts mounted thereon.

In accordance with still another feature of the present invention, this problem is solved by providing auxiliary mechanism 50 with a temperature compensating mechanism which relieves the binding forces resulting from the thermal expansion and contraction of the body of the clarinet. In so doing these forces are kept to levels which assure that the auxiliary mechanism cannot freeze-up or otherwise interfere with the playing of the instrument in its unextended Boehm system mode.

Figure 5:
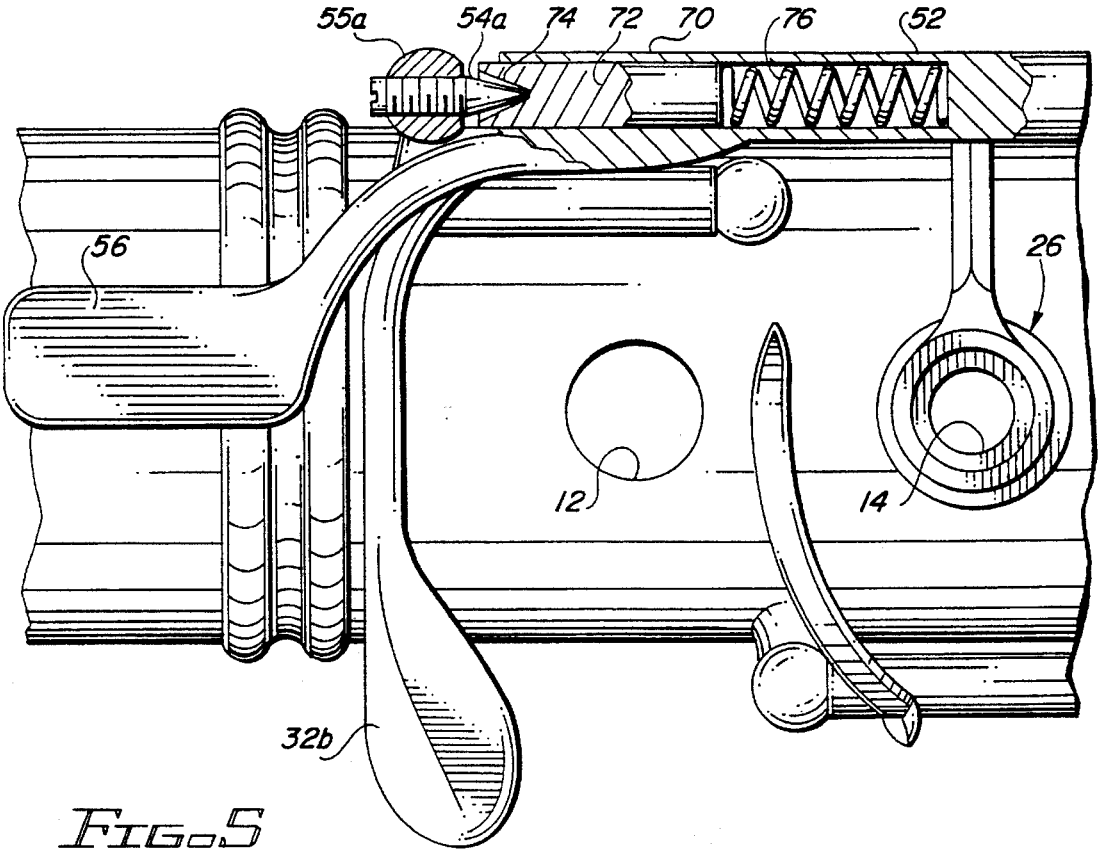
FIG. 5 is an enlarged, partly cutaway fragmentary top view of the part of the clarinet which is near the C sharp key.

The preferred embodiment of the compensating mechanism of the invention is shown in enlarged fragmentary cross-sectional form in FIG. 5. In the latter figure it will be seen that the spatula-bearing or actuating end of auxiliary shaft 52 defines a longitudinally disposed cylindrical recess 70. Positioned within recess 70 is a cylindrical compensating member or bushing 72 having an outer bearing surface 74 which is adapted to receive and journal the tip of male needle bearing member 54*a* and having an inner surface which is adapted to bear against a compensating spring 76 of the compression type. Cooperating with, but not itself forming a part of the present invention, is a conventional bearing mounting post 55*a* which adjustably and threadedly mounts bearing member 54*a* in the conventional manner.

In accordance with the present invention compensating bushing 72 is preferably sized so that it slides smoothly yet snugly inwardly and outwardly within recess 70, i.e., is not so loose as to result in any noticeable wobble. As a result, when the body of the clarinet contracts in the presence of lower temperatures, bushing 72 slides inwardly within recess 70 further compressing spring 76, but limiting the functional forces between bearing members 54*a* and 72 to acceptably low levels. Conversely, when the body of the clarinet expands in the presence of higher temperatures, bushing 72 slides outwardly within recess 70, allowing spring 76 to expand, but keeping the frictional forces between bearing members 54*a* and 72 the same at all temperatures. As a result, auxiliary shaft 52 never experiences a thermally induced condition in which it either freezes up or becomes sloppily loose and, consequently, can never interfere with the playing of the clarinet in its unextended Boehm system mode.

While compensating bushing 72 is especially suited for preventing the freeze-up of the auxiliary shaft of the invention, it is not limited to use with that shaft. On the contrary, any shaft of the clarinet, or indeed of any woodwind instrument which is subject to thermally induced binding or freeze-up problems would benefit from the inclusion of a compensating mechanism of the kind shown in FIG. 5. The compensating mechanism of the invention could also be used in brass instruments, though the more or less evenly matched coefficients of expansion of the parts of such instruments would make thermal compensation less important than in woodwind instruments.

In accordance with a further feature of the compensating mechanism of the invention, it is desirable that it be located on the actuating or spatula-bearing end of a shaft and not on the actuated or cup-bearing end of a shaft. This is because the distance between the pad cups and any fixed bearing surface at the actuated end of a shaft is somewhat critical. As a result, it is desirable that such distances not vary with thermal effects. Since the distance between the cups and the actuating end of a shaft is less critical, any negative effects of the presence of a compensating bushing at that end of the shaft are minimal.

In view of the foregoing it will be seen that the present invention provides a multi-faceted improvement to the operation of the A, A flat and B flat keys of a clarinet. Firstly, the adjustable linkage mechanism of the invention makes the operation of the A and A flat keys smoother, quieter and more reliable while retaining an easily adjustable key feel. Secondly, the auxiliary shaft mechanism of the invention facilitates the playing of formerly difficult trills, tremolos, etc. simply and without affecting the playability of the instrument in strict accordance with the Boehm system. Thirdly, the compensating mechanism of the invention solves definitively the problem of shaft binding incident to changes in the temperature of the instrument.

It will be understood that while the present invention has been described with reference to particular examples and preferred embodiments, the true spirit and scope of the present invention should be determined only with reference to the appended claims.

What is claimed is:

1. A Boehm system clarinet of the type having a wooden body and A, A flat, and B flat keys each including an actuating spatula and a pad bearing cup, characterized by:

a) a first auxiliary needle bearing attached to said body in rough proximity to the spatulas of the A and A flat keys;

b) a second auxiliary needle bearing attached to said body in rough proximity to the spatula of the B flat key;

c) an auxiliary shaft journalled in and between said first and second needle bearings;

d) an auxiliary spatula extending from said shaft in rough proximity to the B flat key;

e) an auxiliary arm extending from said shaft and into contact with the spatula of the A key;

f) said auxiliary shaft, spatula and arm together defining an auxiliary mechanism for operating the A key with a finger of the right hand without affecting the normal operation of the A key with a finger of the left hand.

2. A clarinet as set forth in claim 1 in which the auxiliary spatula the spatula of the B flat key are close enough to be operated with a single finger.

3. A clarinet as set forth in claim 1 in which the clarinet side of the spatula of the A key includes an arm engagement structure adapted to movably engage the auxiliary arm, and the auxiliary arm includes a cooperating spatula engagement structure adapted to movably engage said arm engagement structure.

4. A clarinet as set forth in claim 3 in which the arm engagement structure comprises an inwardly projecting member defining a rounded socket, and in which the auxiliary arm has a rounded end adapted to fit into said socket to form a ball and socket engagement between the auxiliary arm and the spatula of the A key.

5. A clarinet as set forth in claim 1 further including a needle bearing bushing that is short in relation to the length of the auxiliary shaft, in which the spatula end of the auxiliary shaft defines a recess for longitudinally receiving said bushing, and in which said bushing is positioned in said recess in journalling relationship to the second needle bearing to limit bearing binding forces resulting from the thermal expansion and contraction of said body.

6. A clarinet as set forth in claim 5 further including a spring positioned inside said recess to apply to said bushing a force which tends to push it out of said recess.

7. A clarinet as set forth in claim 1 further including an elongated link member bridging the space between the inner surface of the A flat key and the outer surface of the A key, said member serving to allow the A key to move the A flat key without first having to strike the A flat key.

8. A clarinet as set forth in claim 7 in which the link member has a first end and a second end, in which the first end of the member is adapted to smoothly engage the A flat key and in which the second end of the member is adapted to smoothly engage the A key.

9. A clarinet as set forth in claim 8 in which both ends of the link member are convexly rounded and in which the portions of the keys which are in rotatable engagement therewith are concavely rounded and have curvatures similar to those of the respective ends of said member.

10. A clarinet as set forth in claim 7 including adjusting means abutting said link member for adjusting the separation between the A and A flat keys.

11. A clarinet as set forth in claim 10 in which the adjusting means comprises an adjusting screw and a cooperating threaded member attached to one of said keys.

12. A Boehm system clarinet of the type including a wooden body and A, A flat and B flat keys each including an actuating spatula and a pad bearing cup, characterized by:

a) auxiliary A key operating means for actuating the A key with a finger of the right hand, said auxiliary operating means including:
   (i) an auxiliary shaft having a first end and a second end;
   (ii) an auxiliary spatula extending from the second end of said shaft for controlling the rotation thereof; and
   (iii) an auxiliary arm extending from the first end of said shaft in the direction of the spatula of the A key;

b) engagement means extending from the spatula of the A key into engagement with the auxiliary arm for actuating the A key when the auxiliary spatula is depressed; and c) mounting means for mounting said auxiliary operating means on said body.

13. The clarinet of claim 12 in which the auxiliary spatula is located near the spatula of the B flat key.

14. The clarinet of claim 13 in which the auxiliary spatula is close enough to the spatula of the B flat key that the auxiliary spatula and the spatula of the B flat key may be operated with the same finger.

15. A clarinet as set forth in claim 14 in which the inner surface of the A flat key includes a linkage engagement structure oriented in the direction of the A key, and in which the outer surface of the A key includes a linkage engagement structure oriented in the direction of the A flat key, and which further includes linkage means bridging said engagement structures for assuring that the A key can move the A flat key without first striking the same.

16. A clarinet as set forth in claim 14 in which the second end of the auxiliary shaft defines a compensating recess, and which further includes a compensating member one end of which is adapted to slide smoothing inwardly and outwardly along said recess and the other end of which defines a bearing engagement surface, and a spring located within said recess to apply an outward directed force to said member.

17. A clarinet as set forth in claim 12 in which the engagement means comprises a ball and socket joint formed by the end of the auxiliary arm and the inner surface of the A key.

18. A clarinet as set forth in claim 12 in which the second end of the auxiliary shaft defines a compensating recess, and which further includes a compensating member one end of which is adapted to slide smoothing inwardly and outwardly within said recess and the other end of which defines a needle bearing engagement surface, and a spring located within said recess to apply an outward directed force to said member.

19. A clarinet as set forth in claim 18 in which the inner surface of the A flat key includes a linkage engagement structure oriented in the direction of the A key, and in which the outer surface of the A key includes a linkage engagement structure oriented in the direction of the A flat key, and which further includes linkage means bridging said engagement structures for assuring that the A key can move the A flat key without first striking the same.

20. A clarinet as set forth in claim 12 in which the inner surface of the A flat key includes a linkage engagement structure oriented in the direction of the A key, and in which the outer surface of the A key includes a linkage engagement structure oriented in the direction of the A flat key, and which further includes linkage means bridging said engagement structures for assuring that the A key can move the A flat key without first striking the same.

21. In a musical instrument that includes one or more rotatable shafts each of which is rotated by at least one spatula attached to one, actuating end thereof and raises and lowers at least one pad bearing cup attached to the other, actuated end thereof, and each of which is journalled in and between a pair of bearing elements mounted on the body of the instrument, in combination:

a) at least one shaft having one end which defines a longitudinally disposed recess;

b) a compensating member having a first end which defines a bearing surface adapted to engage a respective bearing element and a second end adapted to fit into said recess; and c) means located within said recess for applying to the compensating member a force which tends to push said member against the respective bearing element;

d) whereby the shaft is able to rotate freely in spite of the thermal expansion and contraction of the body of the instrument.

22. A musical instrument as set forth in claim 21 in which said recess is located in the actuating end thereof.

23. A musical instrument as set forth in claim 21 in which said applying means comprises a spring.

24. An improved shaft assembly for use in musical instruments of the type having at least one shaft journalled in and between a pair of needle bearings attached to the body of the instrument comprising, in combination:

a) a shaft having a first end which defines a compensating recess and a second end which is adapted to journal the male portion of one of said needle bearings, b) a compensating element having an outer end and an inner end and having a size and shape which allows said inner end to slide smoothly inwardly and outwardly within said compensating recess, the outer end of said bushing defining a surface for journalling the male portion of the other of said needle bearings, and c) means located in said recess, between said shaft and said compensating element, for applying an outward force to said compensating element.

25. A shaft assembly as set forth in claim 24 in which the instrument is of the type having a spatula projecting therefrom near one, actuating end thereof and a pad bearing cup projecting therefrom near the other, actuating end thereof, and in which said compensating recess is located at said actuating end.

26. A shaft assembly as set forth in claim 24 in which said applying means comprises a spring.

27. A musical instrument of the type having a plurality of keys each including an arm which supports an actuating spatula and a pad bearing cup, and having at least two keys so arranged that, during the playing of at least one note, the arm of a first key moves the arm of a second, adjacent key, characterized by:

a) a first key having an arm defining a recess which opens in the direction of the second key;

b) a second key having an arm defining a recess which opens in the direction of the first key; and c) an elongated separator having a first end shaped to smoothly engage the recess of said first key and a second end shaped to smoothly engage the recess of said second key;

d) said separator being disposed in bridging relationship between said first and second keys, with the ends thereof resting in respective recesses, to assure that, when the two keys move together, they do so without having to first establish contact with one another.

28. An instrument as set forth in claim 27 further including adjusting means abutting one end of said separator for adjusting the separation between the first and second keys.

29. An instrument as set forth in claim 28 in which said adjusting means comprises an internally threaded member secured to one of the keys, and which further includes a screw threaded therein for adjusting the depth to which the separator penetrates into said member.

30. An instrument as set forth in claim 29 in which the end of the screw that abuts the separator and the abutted end of the separator define curved surfaces with similar curvatures.

31. An instrument as set forth in claim 29 in which the end of the threaded member penetrated by the separator has an opening with a diameter which is too small to allow the separator to escape therethrough.

32. An instrument as set forth in claim 31 further including means attached to the end of the threaded member for preventing the separator from escaping through said opening when the screw is not threaded in said threaded member.

33. An instrument as set forth in claim 27 in which each recess and the end of the separator engaged therewith together form a ball and socket joint.

34. A musical instrument of the type having a plurality keys each including an arm which supports an actuating spatula and a pad bearing cup and having at least two keys so arranged that, during the playing of at least one note, the arm of a first key moves the arm of a second, adjacent key, characterized by:

a) a first key having an arm including a first linkage engagement structure oriented in the direction of the second key;

b) a second key having an arm including a second linkage engagement structure oriented in the direction of the first key; and c) linkage means engaging said first and second linkage engagement structures for assuring that the first key can move the second key without first striking the same.

35. An instrument as set forth in claim 34 further including adjusting means abutting said linkage means for adjusting the separation between the first and second keys.

36. An instrument as set forth in claim 35 in which said adjusting means comprises a threaded housing secured to one of said keys for adjusting the depth to which the linkage means penetrates into said housing.

37. An instrument as set forth in claim 36 in which the end of the screw that abuts the linkage means and the abutted end of the linkage means define curved surfaces with similar curvatures.

38. An instrument as set forth in claim 36 in which the end of the housing penetrated by the linkage means has an opening which is too small to allow the end of the linkage means to escape therethrough.

39. An instrument as set forth in claim 38 further including means attached to the housing for preventing the linkage means from escaping through said opening when the screw is not threaded in said housing.

40. An instrument as set forth in claim 34 in which the first and second linkage engagement structures and the linkage means together form ball and socket joints.

* * * * *

UNITED STATES PATENT AND TRADEMARK OFFICE

CERTIFICATE OF CORRECTION

PATENT NO. : 5,477,766

DATED : December 26, 1995

INVENTOR(S) : Clifford Ellsworth

It is certified that error appears in the above-identified patent and that said Letters Patent is hereby corrected as shown below:

Columns 1-12 should be deleted to appear as per attached columns 1-12.

Signed and Sealed this

Twenty-first Day of May, 1996

*Attest:*

Bruce Lehman

BRUCE LEHMAN

*Attesting Officer*

*Commissioner of Patents and Trademarks*

BOEHM SYSTEM CLARINET HAVING IMPROVED A KEY MECHANISM

BACKGROUND OF THE INVENTION

The present invention relates to Boehm system clarinets and is directed more particularly to a Boehm system clarinet which includes an improved A key operating mechanism which allows the A key to be operated by a finger of the right hand without affecting its normal operability by a finger of the left hand.

In a clarinet which is structured and played according to the Boehm system there are a number of problems inherent in the use of the A, A flat and B flat keys. One of these is that there are a number of note sequences which are difficult and/or awkward to play. Two of these, the trills between A and A flat and A flat and B flat, are so awkward, particularly if they must be played rapidly, that they are often avoided or "faked", i.e., produced by the fingering of keys other than those that are called for and only approximating the sound that is called for. Other note sequences, such as the full triad tremolo and tremolos between F and B flat, E flat and B flat, and G flat and B flat are simply difficult to play rapidly because of their tonal separation. Even more difficult are the full triad tremolos between E and A, E flat and A, and D and A.

In addition, there are a number of well known passages which are so difficult that they cannot be played by many highly experienced clarinet players. One of these, the so-called Hora Staccato, calls for the repetitive playing of the note sequence E, B flat, G, B flat. Another, the first clarinet part from the Perpetuum Mobile of Novacek, calls for rapid (presto) alterations between higher and lower B flats. As a result of these difficulties, it has been a not uncommon practice for composers to routinely consult with experienced clarinet players to determine if their compositions present problems that make it advisable that certain passages be deleted or modified.

Prior to the present invention many attempts have been made to eliminate the problems inherent in the Boehm system. One of these, described in U.S. Pat. No. 1,546,153 (Upton), recognizes the above-described problems and describes trilling A and A flat (G sharp) using the first and second joints of the left index finger. However, Upton's solution not only fails to facilitate rapid trilling from A flat to B flat, but also introduces a violation of the standard Boehm fingering scheme.

Another of these attempts, described in U.S. Pat. No. 3,079,828 (LeBlanc), is based on a mechanism which allows the A note to be sounded with the third finger of the right hand. While this mechanism ameliorates certain of the above-described trilling difficulties, it is complicated and therefore potentially unreliable because it utilizes differentially actuating springs. In addition, because of spring interactions, it causes the A key to have an unfamiliar "feel".

Yet another of these attempts, described in U.S. Pat. No. 4,206,680 (Hanson et al), ameliorates certain of the above-described trilling difficulties, but uses a mechanism which is complicated and interferes with the C–D trill above the staff.

Still other attempts to solve the problems which are solved definitively by the present invention are described in the following U.S. Pat. Nos. 878,333 (Bonn), 2,832,250 (LeBlanc), 3,238,833 (Brodzky) and 4,793,235 (Yamaryo).

Another problem inherent in the use of the A key is that it operates in conjunction with the A flat key. More particularly, the depression of the spatula of the A key results in the lifting not only of the A note pad cup, but also the A flat note pad cup. Because the rocker arms of the A and A flat keys are not initially in contact, this leads to an annoying click each time the A note is played and to a peculiar key "feel". Although these effects are reduced by the inclusion of an adjustment screw and an associated pad of cork, they are not eliminated. In any case, the cork pad has a relatively short useful life because it is frequently struck by the end of the adjustment screw.

SUMMARY OF THE INVENTION

In accordance with the present invention there is provided a set of related improvements which definitively solve the above described problems. One of these is an auxiliary A key mechanism which allows the A key to be played with equal ease either by a finger of the right hand or by a finger of the left hand. One beneficial result of the inclusion of this mechanism is that the difficult trills from A to A flat and A flat to B flat can be made easily and with great rapidity even by inexperienced players. Another is that the very difficult tremolos between E and A, E flat and A, and D and A can be made comfortably even when played very rapidly. Thus, the present invention makes easy and routine the playing of trills and tremolos that have been notorious for their difficulty.

In the preferred embodiment, the auxiliary A key mechanism includes an auxiliary shaft having an auxiliary spatula which is in rough proximity to the spatula of the B flat key and which is easily operable by the right index finger. This location makes it possible for a player to play A and B flat with the same finger, thereby simplifying the trill between A and B flat and increasing the speed at which it may be performed. In addition, by releasing the left index finger from its task of operating the A key, the auxiliary mechanism of the invention makes easy the playing of passages, such as the previously mentioned Hora Staccato and Perpetuum Mobile, with their many repetitions of B flat. Thus, the auxiliary A key mechanism of the present invention not only facilitates the playing of trills, tremolos and passages of extraordinary difficulty, it also simplifies the playing of trills of only ordinary difficulty.

In accordance with the present invention the auxiliary A key mechanism includes an auxiliary arm that extends from the auxiliary shaft in rough proximity to the spatula of the A key. This shaft engages the lower (inner) surface of that spatula and serves to allow the A key to be operated from below. This advantageous arrangement allows the key to remain operable in the normal manner (i.e., from above) by the left index finger. This is important because it prevents what would otherwise be a violation of the Boehm fingering scheme. In other words, the instrument is still playable exactly according to the Boehm system, but its playability has been extended by the inclusion of the ability to operate the A key with the right index finger. Thus, the clarinet may be said to incorporate an extension of the Boehm system.

In the preferred embodiment of the invention, the auxiliary shaft is provided with a compensating bushing which moves in and out of a longitudinal opening in the end of the auxiliary shaft as the wooden body of the clarinet expands and contracts with changes in temperature. In this manner there is avoided the possibility that the contraction of the body will cause so much pressure to be applied between the auxiliary shaft and its needle bearings that the shaft will be unable to rotate, i.e., will "bind" or "freeze up". While the importance of this feature is related to the relatively great length of the auxiliary shaft, its utility is not restricted to use with that shaft. It will therefore be understood that the compensating bushing may be used on any shaft on the clarinet which is long enough to be subject to thermally induced freeze-up problems or, more generally, on the shafts of other woodwind or even brass instruments.

Another improvement afforded by the present invention is a separator or linkage mechanism which bridges the arms of the A and A flat keys. This bridging action has the effect of keeping these rocker arms in contact, except when A flat is played by itself. As a result the A key is able to lift the A flat pad cup without having to first strike the A flat key, thereby eliminating the previously mentioned clicking sound. At the same time, the operation of the A key is made smoother and exhibits a much improved feel.

In the preferred embodiment, the linkage mechanism is included as a part of the interkey adjusting mechanism for the A and A flat keys. This coupling of the linkage function with the adjustment function assures that the benefits provided by the linkage mechanism are not lost as a result of adjustments to the A—A flat key gap.

DESCRIPTION OF THE DRAWINGS

Other objects and advantages of the present invention will be apparent from the accompanying drawings in which:

FIG. 1 is a fragmentary top view showing the part of a clarinet on which the invention is used;

FIG. 2 is a fragmentary, partly cut away, side view of the part of a clarinet which is near the A and A flat keys;

FIG. 3 is a cross-sectional view of the clarinet taken along the section 3—3 shown in FIG. 2;

FIG. 4 is a enlarged partial cross sectional view of the clarinet taken along the section 4—4 shown in FIG. 2; and FIG. 5 is an enlarged, partly cutaway fragmentary top view of the part of the clarinet which is near the C sharp key.

DESCRIPTION OF THE PREFERRED EMBODIMENTS

Referring to FIG. 1, there is shown a fragmentary top view of the mouthpiece end of a clarinet which has been modified to incorporate the improvements contemplated by the present invention. This clarinet includes a wooden body or tube 10 through which a number of sound holes have been drilled. Hole 12, for example, is open. Holes 14 and 16 are associated with the E and F sharp (G flat) notes, respectively. The remaining sound holes that are located on the section of the clarinet shown in FIG. 1 are not visible in that figure because they are obscured by the pad-bearing cups that cover them. Such holes will be discussed presently in connection with their respective key mechanisms.

The clarinet of FIG. 1 also includes a number of key mechanisms or keys that open and close to control the flow of air through respective sound holes. These include an A key 20 having a pad cup or cup 20*a* that controls the flow of air through the A sound hole (not visible in FIG. 1) and a finger pad or spatula 20*b*. The cup and spatula are joined by an arm 20*c* formed integrally with a shaft 20*d* that is journalled threadedly mounted within bearing posts 20*e* and 20*f*. Together these structures comprise a rocker mechanism that uncovers the A hole when A spatula 20*b* is depressed. Similarly, A flat (G sharp) key 22 includes a cup 22*a*, a spatula 22*b*, an arm 22*c*, a shaft 22*d*, and bearing posts 22*e* and 22*f* (post 22*f* being common to the A and A flat keys), and uncovers the A flat hole when spatula 22*b* is depressed or, as will be described more fully later, when spatula 20*b* is depressed.

The clarinet of FIG. 1 also includes keys that control the E and F sharp (G flat) notes, via holes 14 and 16. Key 24, for example, controls the F sharp note and includes a finger-closeable hole cover 24*a* and a spatula 24*b*. It should be noted that the linkages, shafts, return springs, etc. that form parts of the F sharp key have been left out of FIG. 1 because they are conventional and because their showing would only serve to obscure the parts of the clarinet that form a part of the present invention. Similarly, key 26 controls the E flat note and includes a finger-closeable ring 26*a* and a spatula 26*b*. Associated with E flat key 26 is an E flat helper key 26'. Finally, spatulas 30*b* and 32*b* form parts of the B flat and C sharp keys, respectively, while spatula 34*b* forms a part of the C trill key. The sound holes, linkages, etc. of the last mentioned keys are not for the most part visible in FIG. 1.

Turning now to FIGS. 2 and 3, there are shown respective side and front elevations of A and A flat keys 20 and 22. As shown in FIG. 2, arm 22*c* of A flat key 22 extends over or bridges arm 20*c* of A key 20, being separated therefrom by a gap 38. In operation, this bridging relationship and gap allows the A flat note to be played independently of the A note, since the depression of A flat spatula 22*b* (see FIG. 3) causes the A flat pad cup 22*a* to lift without also lifting A note pad cup 20*a*. In playing the A note, however, the depression of A key spatula 20*b* leads not only to the raising of pad cup 20*a*, but also the raising of pad cup 22*c*, i.e., causes both of their respective sound holes to be open at the same time. Prior to the present invention the two sound holes did not open simultaneously, however, since rising arm 20*c* took time to traverse gap 38 before first striking arm 22*c*. Prior to the present invention, this time was made adjustable by including on arm 22*c* a screw which adjustably projected into gap 38 and made contact with arm 20*c* through a cork pad (not shown). While this screw allowed the "feel" of the A key to be adjusted, the making of the contact between arms 20*c* and 22*c* produced a clicking sound, particularly after the cork pad had deteriorated from use.

In accordance with one feature of the present invention, one of the above-described unpleasant aspects of the use of the A key is eliminated by providing an adjustable separator or linkage mechanism 40 which is most easily seen in FIG. 4. As will be explained more fully presently, mechanism 40 significantly improves the smoothness and simultaneity of the opening of cups 20*a* and 22*a* by allowing arm 20*c* to move arm 22*c* without having to first strike the same, i.e., without having to move into contact therewith. This not only eliminates the above-mentioned clicking noise, it also improves the purity of the note by eliminating the time when only one of the sound holes is uncovered. Moreover, this result is produced without affecting the adjustability of the width of gap 38, thereby preserving the ability of the user to adjust the "feel" of the A key.

Referring to FIG. 4, there is shown a fragmentary cross-sectional view of one embodiment of linkage mechanism 40. The latter includes an elongated separator or link 42 which is disposed in bridging relationship between key arms 20*c* and 22*c*. Mechanism 40 also includes an adjustment screw 44 which is threaded in a member 46 that is secured to arm 22*c* of A flat key 22. In view of this structure it will be seen that the tightening of screw 44 pushes link 42 further out of member 46 and thereby increases the separation (gap 38) between keys 20 and 22.

A first end 48 of link 42 has a generally rounded shape having a curvature which matches that of the upper surface of a recess 50 that is formed in arm 20*c* and forms a ball and socket type of engagement therewith. Similarly, the other end 52 of link 42 has a generally rounded shape having a curvature which matches that of the lower surface of a recess 54 that is formed in the end of screw 44 and forms a ball and socket type of engagement therewith. Because of the use of this type of engagement it will be seen that, whatever the relative motions of arms 20*c* and 22*c*, link 42 cannot apply to those arms forces which are perpendicular to the plane of rotation of the key and which would therefore tend to cause the keys to bind.

It should be noted that, because recess 54 forms a part of screw 44, the ball and socket engagement between link 42 and arm 22*c* is not affected by the depth to which screw 44 penetrates member 46. As a result, so long as the interior opening 56 through member 46 is sufficiently long to allow a reasonable range of inward and outward movement for link 42, the engagement between link 42 and keys 20 and 22 will remain smooth. This assures that screw 44 may be adjusted as necessary to produce the desired separation between those keys without affecting the smoothness of the engagement. This, in turn, affects the force which must be used to depress A key 20 and therefore the feel of that key.

In the preferred embodiment, the inner (clarinet) end 56*a* of opening 56 has a smaller diameter than the remainder thereof. This smaller diameter assures that link 42 is held between end 56*a* and screw 44 and is therefore unable to escape from member 46. Similarly, the depth of recess 50 in arm 20*c* is selected so that end 48 of link 42 cannot escape therefrom when A flat key 22 is operated independently of A key 20. When the latter key is not depressed, the end 48 of link 42 is retained within recess 50 by the action of the A flat key return spring (not shown). Thus, spacer 42 is maintained in the desired bridging relationship between keys 20 and 22 under all conditions of use or non-use of the clarinet.

As stated previously, the clicking sound associated with the A keys of clarinets constructed in accordance with the present invention is eliminated by the use of the linkage mechanism shown in FIGS. 2–4. The reason is that link 42 serves to maintain a smooth non-binding engagement between keys 20 and 22. Since these keys will normally be in contact, there is no occasion for the production of the clicking sound that had been produced when the A key first struck the A flat key. Such sound as is produced as the A flat key returns to its rest position after being played independently of the A key (i.e., when end 48 of link 42 comes to rest in the bottom of recess 50) is minimal and unobjectionable since link 42 slides smoothly in the recesses between which it is positioned and since its stoppage is cushioned by the return springs of the A and A flat keys.

As explained previously, under the Boehm system, the A and A flat keys are arranged so that they are both operated by the left index finger. While this fingering presents no problem when the A and A flat notes are played separately, or when these notes are trilled slowly, it becomes a problem when A and A flat must be trilled rapidly. Another awkward fingering problem is presented by the rapid trilling between A flat and B flat. Still further problems are presented by the rapid playing of full triad tremolos and other notoriously difficult passages.

In accordance with the present invention, the above-mentioned problems are solved definitively by the inclusion of an auxiliary A note mechanism which allows the A key to be operated with equal ease by the index fingers of either hand, and which does not comprise a violation of the Boehm system. In the embodiment of FIG. 1 this mechanism as a whole is designated by the numeral 50 and extends generally from rough proximity to the spatula 30*b* of the B flat key to rough proximity to the spatula 20*b* of the A key. More particularly, auxiliary mechanism 50 includes an auxiliary shaft 52 which is journalled in and between a pair of needle bearings 54*a* and 54*b* which are, in turn, supported on respective bearing posts 55*a* and 55*b* that are screwed into the body of the clarinet. Auxiliary mechanism 50 also includes an auxiliary spatula 56 which extends from one end of shaft 52 in rough proximity to B flat spatula 30*b* and an auxiliary arm 58 which extends from the opposite end of shaft 52 in rough proximity to A spatula 20*b*. Finally, auxiliary mechanism 50 is an extension of the A key. They move together responsive to the spring associated with the A key. It will be understood that while both the presence of auxiliary mechanism 50 and its location are unconventional, the levers, bearings, etc. which it employs are, except as hereinafter noted, conventional. Accordingly, the latter aspects of the present invention will not be described in detail herein.

In accordance with an important feature of the present invention, auxiliary mechanism 50 in general and arm 58 in particular are arranged so that the depression of auxiliary spatula 56 by the right index finger results in the depression of A key spatula 20*b*, i.e., in the playing of the A note. In the embodiment of FIG. 1 this is accomplished by causing auxiliary arm 58 to engage the underside of spatula 20*b* and pull the same down from its under or inner (clarinet) side. In other words, auxiliary mechanism 50 produces from below with the right index finger, an actuation of the A key which is indistinguishable from the actuation of that key from above by the left index finger. As a result, A spatula 20*b* can be operated interchangeably either with the left index finger, exactly as called for by the Boehm system, or with the right index finger under an extension of the Boehm system which is fully compatible therewith.

In the embodiment of FIG. 1 the desired engagement between arm 58 and spatula 20*b* is afforded by providing arm 58 with a rounded end 60 which serves as a spatula engagement structure and by providing the underside of spatula 20*b* with an inwardly projecting member 62 having a rounded (socket shaped) recess 64 which serves as a arm engagement structure. Together these cooperating structures serves as a ball and socket joint which allows auxiliary spatula 56 to smoothly and reliably control the A key from the vicinity of the B flat spatula. The structure of member 62 and socket 64 are most clearly seen in FIG. 2. It will be understood, however, that any arm—spatula engagement mechanisms which can serve to smoothly link arm 58 with the underside of spatula 20*b* can be used in place of the ball and socket mechanism of FIGS. 1 and 2 is within the contemplation of the present invention.

One additional advantage of locating auxiliary spatula 56 in rough proximity to B flat spatula 30*b* is that it facilitates rapid trilling between A and B flat by allowing this trill to be performed comfortably with the right index finger. While this trill is not particularly difficult with the usual two fingers, it can now be performed as easily or even more easily with a single finger, thereby freeing one finger for playing notes that would not otherwise be playable in conjunction with the A–B flat trill.

Because auxiliary A key mechanism 50 is used as an optionally usable extension of the Boehm system, and because it has a relatively long shaft, it is particularly important that it not subject the playing of the clarinet in its unextended Boehm system mode to an increased risk that the A key will bind or freeze-up as a result of the thermal expansion and contraction of the body of the clarinet. In conventional Boehm system clarinets shafts that are relatively long are always subject to the risk of binding or freezing-up because the coefficient of expansion of the wooden body of the clarinet is substantially greater than that of the shafts mounted thereon.

In accordance with still another feature of the present invention, this problem is solved by providing auxiliary mechanism 50 with a temperature compensating mechanism which relieves the binding forces resulting from the thermal expansion and contraction of the body of the clarinet. In so doing these forces are kept to levels which assure that the auxiliary mechanism cannot freeze-up or otherwise interfere with the playing of the instrument in its unextended Boehm system mode.

The preferred embodiment of the compensating mechanism of the invention is shown in enlarged fragmentary cross-sectional form in FIG. 5. In the latter figure it will be seen that the spatula-bearing or actuating end of auxiliary shaft 52 defines a longitudinally disposed cylindrical recess 70. Positioned within recess 70 is a cylindrical compensating member or bushing 72 having an outer bearing surface 74 which is adapted to receive and journal the tip of male needle bearing member 54*a* and having an inner surface which is adapted to bear against a compensating spring 76 of the compression type. Cooperating with, but not itself forming a part of the present invention, is a conventional bearing mounting post 55*a* which adjustably and threadedly mounts bearing member 54*a* in the conventional manner.

In accordance with the present invention compensating bushing 72 is preferably sized so that it slides smoothly yet snugly inwardly and outwardly within recess 70, i.e., is not so loose as to result in any noticeable wobble. As a result, when the body of the clarinet contracts in the presence of lower temperatures, bushing 72 slides inwardly within recess 70 further compressing spring 76, but limiting the functional forces between bearing members 54*a* and 72 to acceptably low levels. Conversely, when the body of the clarinet expands in the presence of higher temperatures, bushing 72 slides outwardly within recess 70, allowing spring 76 to expand, but keeping the frictional forces between bearing members 54*a* and 72 the same at all temperatures. As a result, auxiliary shaft 52 never experiences a thermally induced condition in which it either freezes up or becomes sloppily loose and, consequently, can never interfere with the playing of the clarinet in its unextended Boehm system mode.

While compensating bushing 72 is especially suited for preventing the freeze-up of the auxiliary shaft of the invention, it is not limited to use with that shaft. On the contrary, any shaft of the clarinet, or indeed of any woodwind instrument which is subject to thermally induced binding or freeze-up problems would benefit from the inclusion of a compensating mechanism of the kind shown in FIG. 5. The compensating mechanism of the invention could also be used in brass instruments, though the more or less evenly matched coefficients of expansion of the parts of such instruments would make thermal compensation less important than in woodwind instruments.

In accordance with a further feature of the compensating mechanism of the invention, it is desirable that it be located on the actuating or spatula-bearing end of a shaft and not on the actuated or cup-bearing end of a shaft. This is because the distance between the pad cups and any fixed bearing surface at the actuated end of a shaft is somewhat critical. As a result, it is desirable that such distances not vary with thermal effects. Since the distance between the cups and the actuating end of a shaft is less critical, any negative effects of the presence of a compensating bushing at that end of the shaft are minimal.

In view of the foregoing it will be seen that the present invention provides a multi-faceted improvement to the operation of the A, A flat and B flat keys of a clarinet. Firstly, the adjustable linkage mechanism of the invention makes the operation of the A and A flat keys smoother, quieter and more reliable while retaining an easily adjustable key feel. Secondly, the auxiliary shaft mechanism of the invention facilitates the playing of formerly difficult trills, tremolos, etc. simply and without affecting the playability of the instrument in strict accordance with the Boehm system. Thirdly, the compensating mechanism of the invention solves definitively the problem of shaft binding incident to changes in the temperature of the instrument.

It will be understood that while the present invention has been described with reference to particular examples and preferred embodiments, the true spirit and scope of the present invention should be determined only with reference to the appended claims.

What is claimed is:

1. A Boehm system clarinet of the type having a wooden body and A, A flat, and B flat keys each including an actuating spatula and a pad bearing cup, characterized by:

a) a first auxiliary needle bearing attached to said body in rough proximity to the spatulas of the A and A flat keys;

b) a second auxiliary needle bearing attached to said body in rough proximity to the spatula of the B flat key;

c) an auxiliary shaft journalled in and between said first and second needle bearings;

d) an auxiliary spatula extending from said shaft in rough proximity to the B flat key;

e) an auxiliary arm extending from said shaft and into contact with the spatula of the A key;

f) said auxiliary shaft, spatula and arm together defining an auxiliary mechanism for operating the A key with a finger of the right hand without affecting the normal operation of the A key with a finger of the left hand.

2. A clarinet as set forth in claim 1 in which the auxiliary spatula the spatula of the B flat key are close enough to be operated with a single finger.

3. A clarinet as set forth in claim 1 in which the clarinet side of the spatula of the A key includes an arm engagement structure adapted to movably engage the auxiliary arm, and the auxiliary arm includes a cooperating spatula engagement structure adapted to movably engage said arm engagement structure.

4. A clarinet as set forth in claim 3 in which the arm engagement structure comprises an inwardly projecting member defining a rounded socket, and in which the auxiliary arm has a rounded end adapted to fit into said socket to form a ball and socket engagement between the auxiliary arm and the spatula of the A key.

5. A clarinet as set forth in claim 1 further including a needle bearing bushing that is short in relation to the length of the auxiliary shaft, in which the spatula end of the auxiliary shaft defines a recess for longitudinally receiving said bushing, and in which said bushing is positioned in said recess in journalling relationship to the second needle bearing to limit bearing binding forces resulting from the thermal expansion and contraction of said body.

6. A clarinet as set forth in claim 5 further including a spring positioned inside said recess to apply to said bushing a force which tends to push it out of said recess.

7. A clarinet as set forth in claim 1 further including an elongated link member bridging the space between the inner surface of the A flat key and the outer surface of the A key, said member serving to allow the A key to move the A flat key without first having to strike the A flat key.

8. A clarinet as set forth in claim 7 in which the link member has a first end and a second end, in which the first end of the member is adapted to smoothly engage the A flat key and in which the second end of the member is adapted to smoothly engage the A key.

9. A clarinet as set forth in claim 8 in which both ends of the link member are convexly rounded and in which the portions of the keys which are in rotatable engagement therewith are concavely rounded and have curvatures similar to those of the respective ends of said member.

10. A clarinet as set forth in claim 7 including adjusting means abutting said link member for adjusting the separation between the A and A flat keys.

11. A clarinet as set forth in claim 10 in which the adjusting means comprises an adjusting screw and a cooperating threaded member attached to one of said keys.

12. A Boehm system clarinet of the type including a wooden body and A, A flat and B flat keys each including an actuating spatula and a pad bearing cup, characterized by:

a) auxiliary A key operating means for actuating the A key with a finger of the right hand, said auxiliary operating means including:

(i) an auxiliary shaft having a first end and a second end;

(ii) an auxiliary spatula extending from the second end of said shaft for controlling the rotation thereof; and (iii) an auxiliary arm extending from the first end of said shaft in the direction of the spatula of the A key;

b) engagement means extending from the spatula of the A key into engagement with the auxiliary arm for actuating the A key when the auxiliary spatula is depressed; and c) mounting means for mounting said auxiliary operating means on said body.

13. The clarinet of claim 12 in which the auxiliary spatula is located near the spatula of the B flat key.

14. The clarinet of claim 13 in which the auxiliary spatula is close enough to the spatula of the B flat key that the auxiliary spatula and the spatula of the B flat key may be operated with the same finger.

15. A clarinet as set forth in claim 14 in which the inner surface of the A flat key includes a linkage engagement structure oriented in the direction of the A key, and in which the outer surface of the A key includes a linkage engagement structure oriented in the direction of the A flat key, and which further includes linkage means bridging said engagement structures for assuring that the A key can move the A flat key without first striking the same.

16. A clarinet as set forth in claim 14 in which the second end of the auxiliary shaft defines a compensating recess, and which further includes a compensating member one end of which is adapted to slide smoothing inwardly and outwardly along said recess and the other end of which defines a bearing engagement surface, and a spring located within said recess to apply an outward directed force to said member.

17. A clarinet as set forth in claim 12 in which the engagement means comprises a ball and socket joint formed by the end of the auxiliary arm and the inner surface of the A key.

18. A clarinet as set forth in claim 12 in which the second end of the auxiliary shaft defines a compensating recess, and which further includes a compensating member one end of which is adapted to slide smoothing inwardly and outwardly within said recess and the other end of which defines a needle bearing engagement surface, and a spring located within said recess to apply an outward directed force to said member.

19. A clarinet as set forth in claim 18 in which the inner surface of the A flat key includes a linkage engagement structure oriented in the direction of the A key, and in which the outer surface of the A key includes a linkage engagement structure oriented in the direction of the A flat key, and which further includes linkage means bridging said engagement structures for assuring that the A key can move the A flat key without first striking the same.

20. A clarinet as set forth in claim 12 in which the inner surface of the A flat key includes a linkage engagement structure oriented in the direction of the A key, and in which the outer surface of the A key includes a linkage engagement structure oriented in the direction of the A flat key, and which further includes linkage means bridging said engagement structures for assuring that the A key can move the A flat key without first striking the same.

21. A musical instrument of the type having a pluraity of keys each including an arm which supports an actuating spatula and a pad bearing cup, and having at least two keys so arranged that, during the playing of at least one note, the arm of a first key moves the arm of a second, adjacent key, characterized by:

a) a first key having an arm defining a recess which opens in the direction of the second key;

b) a second key having an arm defining a recess which opens in the direction of the first key; and c) an elongated separator having a first end shaped to smoothly engage the recess of said first key and a second end shaped to smoothly engage the recess of said second key;

d) said separator being disposed in bridging relationship between said first and second keys, with the ends thereof resting in respective recesses, to assure that, when the two keys move together, they do so without having to first establish contact with one another.

22. An instrument as set forth in claim 21 further including adjusting means abutting one end of said separator for adjusting the separation between the first and second keys.

23. An instrument as set forth in claim 22 in which said adjusting means comprises an internally threaded member secured to one of the keys, and which further includes a screw threaded therein for adjusting the depth to which the separator penetrates into said member.

24. An instrument as set forth in claim 23 in which the end of the screw that abuts the separator and the abutted end of the separator define curved surfaces with similar curvatures.

25. An instrument as set forth in claim 23 in which the end of the threaded member penetrated by the separator has an opening with a diameter which is too small to allow the separator to escape therethrough.

26. An instrument as set forth in claim 25 further including means attached to the end of the threaded member for preventing the separator from escaping through said opening when the screw is not threaded in said threaded member.

27. An instrument as set forth in claim 21 in which each recess and the end of the separator engaged therewith together form a ball and socket joint.

28. A musical instrument of the type having a plurality keys each including an arm which supports an actuating spatula and a pad bearing cup and having at least two keys so arranged that, during the playing of at least one note, the arm of a first key moves the arm of a second, adjacent key, characterized by:

a) a first key having an arm including a first linkage engagement structure oriented in the direction of the second key;

b) a second key having an arm including a second linkage engagement structure oriented in the direction of the first key; and c) linkage means engaging said first and second linkage engagement structures for assuring that the first key can move the second key without first striking the same.

29. An instrument as set forth in claim 28 further including adjusting means abutting said linkage means for adjusting the separation between the first and second keys.

30. An instrument as set forth in claim 29 in which said adjusting means comprises a threaded housing secured to one of said keys for adjusting the depth to which the linkage means penetrates into said housing.

31. An instrument as set forth in claim 30 in which the end of the screw that abuts the linkage means and the abutted end of the linkage means define curved surfaces with similar curvatures.

32. An instrument as set forth in claim 30 in which the end of the housing penetrated by the linkage means has an opening which is too small to allow the end of the linkage means to escape therethrough.

33. An instrument as set forth in claim 32 further including means attached to the housing for preventing the linkage means from escaping through said opening when the screw is not threaded in said housing.

34. An instrument as set forth in claim 28 in which the first and second linkage engagement structures and the linkage means together form ball and socket joints.

* * * * *